United States Patent [19]

Kummer et al.

[11] Patent Number: 4,580,135

[45] Date of Patent: Apr. 1, 1986

[54] RASTER SCAN DISPLAY SYSTEM

[75] Inventors: David A. Kummer; Darwin P. Rackley, both of Boca Raton; Jesus A. Saenz, Coral Springs, all of Fla.

[73] Assignee: International Business Machines Corporation, Armonk, N.Y.

[21] Appl. No.: 522,895

[22] Filed: Aug. 12, 1983

[51] Int. Cl.[4] ..... G09G 1/14; G09G 1/02

[52] U.S. Cl. ..... 340/750; 340/703; 340/799

[58] Field of Search ..... 340/703, 747, 748, 750, 340/799

[56] References Cited

U.S. PATENT DOCUMENTS 4,150,364 4/1979 Baltzer ..... 340/750 X

*Primary Examiner*—Gerald L. Brigance
*Assistant Examiner*—Vincent P. Kovalick

[57] ABSTRACT

A raster scan display system includes a plurality of storage maps. These maps are addressable in either of two modes. In the first mode each map contains bit mapped data and the maps are addressed together to provide color signals from which color video signals are derived. In the second mode, one map contains character representing data and a further map, character display dot patterns. In this mode the first map is addressed to provide partial addresses for the further map. These partial addresses are combined with row scan data signals to access the further map from which the character display dot data is used to generate the video signals.

7 Claims, 5 Drawing Figures

RASTER SCAN DISPLAY SYSTEM

TECHNICAL FIELD

This invention relates to raster scan display systems, and in particular to such systems which employ plural storage devices for storage of data to be displayed.

BACKGROUND ART

Raster scan display devices may be divided into two general groups. The first of these groups is the character generator system in which a character set for display is held in a store and this store is accessed at locations each of which corresponds to one character in the set.

One example of such a system can be seen in U.S. Pat. No. 3,543,244 (Cuccio). In this system, a display controller forms a part of a data communication system and controls the display of incoming data on a plurality of displays. Input data is stored in a memory and is read therefrom to generate addresses of a character generator. The character generator, under the control of a display timing circuit, produces individual character data in response to the addresses from the memory, and applies this data to a video distributor for display on one or more display devices.

In U.S. Pat. No. 3,614,766 (Kievit), a character generator is accessed by a Y matrix counter and an X matrix counter to produce character data for display on a T.V. monitor. Prior to transmission to the monitor, the character data is mixed with color data from a core memory to produce composite display signals.

U.S. Pat. No. 4,068,225 (Lee) shows another character generator system in which character data for display is held in a memory in ASCII code form and read out to a character generator to produce display dot patterns. The generator output is applied to a video register in byte form and serially shifted therefrom in response to signals from a video dot counter.

U.S. Pat. No. 4,117,469 (Levine) shows a display system coupled to a microprocessor. Here again coded character data from a memory drives a character generator to generate video display signals.

Lastly, in U.S. Pat. No. 4,309,700 (Kraemer) video signals in a CRT display system are generated by addressing a character generator in the form of a read-only memory.

The character generator system has the great advantage that it is efficient in the use of memory space. Thus, for example, a character 'A' dot pattern is held in the character generator only once irrespective of the number of times it is used in a full screen of displayed characters. It is, therefore, of particular value for alphanumeric displays. It can also be employed for graphics displays by generating, as characters, portions of lines, straight or curved, to be displayed. Thus, a graphics picture can be built up by the use of successive line 'characters' which join together to provide the required graphic picture. However, this use is limited, especially for high resolution graphics displays, by the need to alter the character generator data frequently in order to accomodate the almost infinite number of curves and angled lines which can be generated and may be required.

In order to overcome this problem, the systems of the second general group were developed. These are the bit-mapped raster graphics systems. In these systems, a pattern of data corresponding to the pattern of dots to be displayed by the display device, is stored. All that is then required is sequential access of the store to read out the dot pattern for display. This system, though relatively expensive in terms of storage capacity requirements, has the advantages that any required dot pattern can be stored and either portions of the pattern or the complete pattern can be rapidly changed.

An example of a bit-mapped raster display system can be seen in an article entitled 'Computer Graphics in Color' by P. B. Denes, which appeared in the Bell Laboratories Record, May 1974 at pages 139 through 146. This uses a memory storing the codes for successive points on the display device in successive memory locations. These codes each comprise three bits which define color information.

U.S. Pat. No. 4,070,710 (Sukonick) shows a system in which a bit mapped memory stores successive points for display. These points are, in fact, more than can be displayed at any one time, so, by selecting different initial addresses in the memory, different displays can be obtained without altering the stored data. Thus, the displayed picture can be panned, both horizontally and vertically, or a split screen display, using data from different portions of the memory, can be created.

Lastly, U.S. Pat. No. 4,149,152 (Russo) shows a bit mapped system which includes an auxilliary memory in addition to the bit mapped memory. The auxilliary memory, which is smaller than the bit mapped memory, stores data specifying dot colors of contiguous dot elements on the display.

DISCLOSURE OF THE INVENTION

The present invention provides a display system in which both the character generator and bit mapped modes of operation can be used. This is of particular advantage in, for example, a micro computer system which is used by a number of operators. Some may want the flexibility of the bit mapped mode for graphics applications and others may require the character generator mode for alpha numeric display applications. No prior system to our knowledge has provided this flexibility by the selective use of a memory either as a bit map or a character generator.

In accordance with the invention there is provided a display system including a plurality of storage devices. These storage devices may either be addressed together to provide bit mapped data to a video generator, or one of the storage devices may be accessed to provide character representing addresses to a further storage device. The data derived from these addresses represents the character dot patterns to be displayed.

Figure 1:
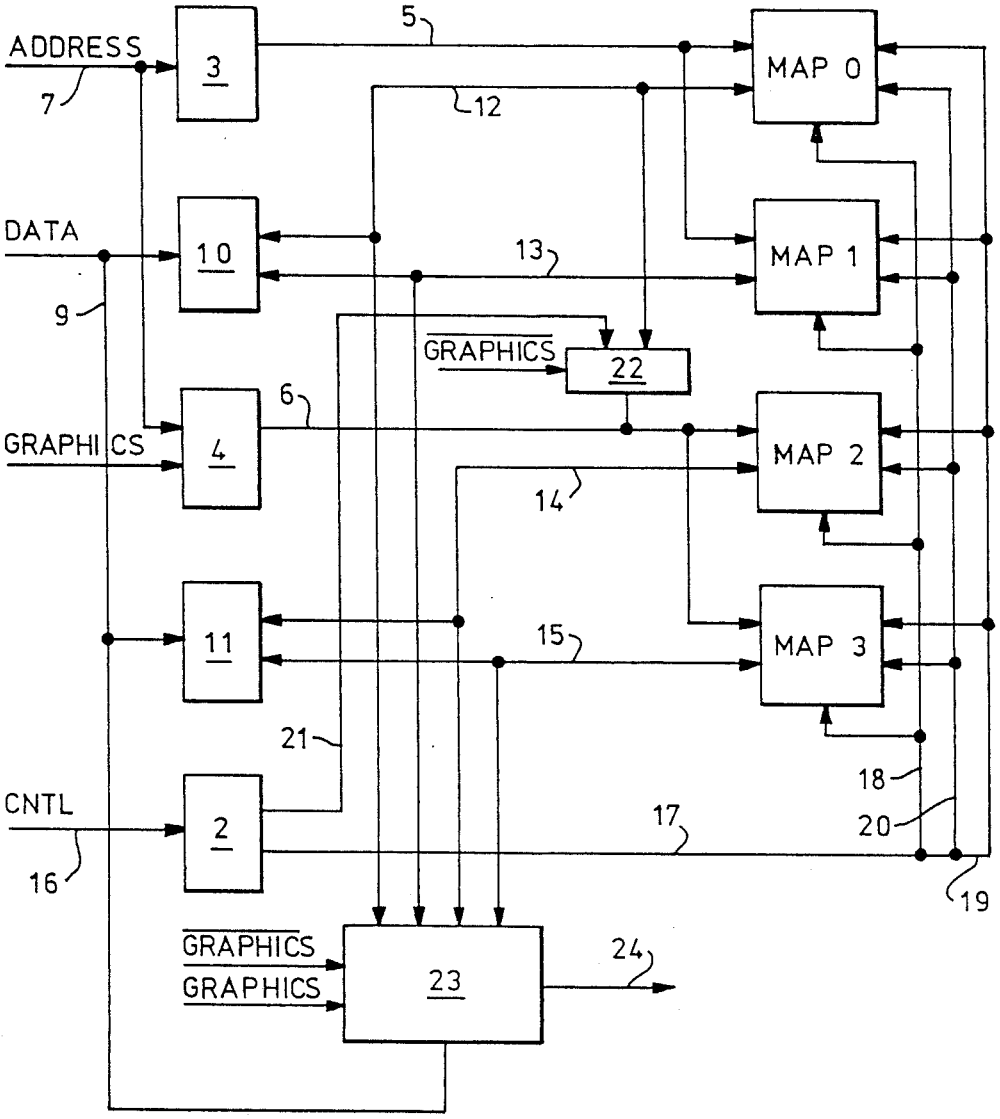
FIG. 1 is a block diagram of a display system embodying the invention.

In the CRT display system of FIG. 1, data defining the images to be displayed on a CRT screen is stored in four memories MAP 0 through MAP 3. Typically, each of these memories has a capacity of 65K 8 bit bytes. The system is normally used in a bit-mapped raster display mode in which each bit stored in the memory corresponds to a particular picture element (pel) on the screen. Each memory contains data representing one color component of the display. Data is written into or read from the stores at addresses defined by address units 3 and 4 over address lines 5 and 6. Address units 3 and 4 receive addresses from a C.P.U. and a CRT controller which are time multiplexed over CPU address bus 7. Logic circuits 10 and 11 couple a CPU data bus to data input/output busses 12, 13, 14 and 15 for the respective memories for the transfer of data bi-directionally between the memories and the CPU. It is noted that circuits 10 and 11 may be arranged to perform logic functions on the transferred data, though these operations will not be detailed further as they form no part of the present invention.

A control circuit 2 is responsive to control and timing signals from the CPU and CRT controller on bus 16 to develop control signals for the memories on a bus 17. The memories are of the dynamic random access type, and therefore require column address strobe (CAS) signals, provided on lines 18, row address strobe (RAS) signals, from lines 19 and write enable (WE) signals from lines 20. The control unit also controls refresh functions of the memories. Control unit also generates row scan signals, indicative of the different scan rows of a character line when the system is operating in the character generation mode, these will be described in more detail later. These row scan signals are passed by a bus 21 to an address circuit 22 which also receives the data output from MAP0. As will be described later, address circuit 22 is employed to address MAP2 in the character generation mode of operation of the system. The last element of FIG. 1 is a color signal generator 23, which is responsive to data from all of the memories on lines 12 through 15 to develop CRT drive signals on output lines 24 in the bit mapped mode, or to data from memories MAP1 and MAP2 to develop such drive signals in the character generation mode. Control signals from the CPU on the GRAPHICS input lines are effective to enable address unit 4 and to switch generator 23 to accept signals from all memories when the system is operating in the bit mapped mode. Similar control signals on the $\overline{\text{GRAPHICS}}$ input lines enable address circuit 22 and switch generator 23 to accept signals from only the inputs from MAP1 and MAP2 when the system operates in the character generation mode.

Before proceeding with a detailed description of the color generator, a general idea of the operation of the system in the bit mapped and character generation modes will now be given.

In the bit mapped mode, each of the stores is initially filled with a bit map representing a single color component of each pel to be displayed. The data is stored as 8 bit bytes, and is read out in sequence byte-by-byte, each of which represents eight consecutive pels. Corresponding locations of each of the bit map stores are read simultaneously, and the four bytes read out at each access are serialized to form four bit streams. Corresponding bits in each of these streams are applied as 4 bit addresses to color palette table in color generator 23. This comprises 16 registers, each 6 bits in length. For each combination of four bits in an address, one of the palette registers applies a six bit parallel output to a color generator circuit. In response to these inputs, the color generator develops a red, a green and a blue CRT drive signal. It is, of course, clear that instead of the red, green and blue drive signals, monochrome signals of different intensity, or color difference signals, can be produced. However, this description, for convenience, will be restricted to the generation of red, green and blue signals for direct drive CRT monitors.

For more details of the color palette system, reference may be made to the Denes article 'Computer Graphics in Color' mentioned above. From this it will be noted that not only can the different registers in the color palette be selected to provide different outputs, but also the content of each register can be updated when required. This is shown in our FIG. 1 system by the connection of the CPU data bus 9 to the color generator 23. With a 6 bit length, therefore, each register in the color palette can be set for 64 different color outputs.

Thus, in the bit mapped mode, each of the memories MAP0 through MAP3 is addressed together to provide a byte of data from which eight pel data groups are generated.

Figure 2:
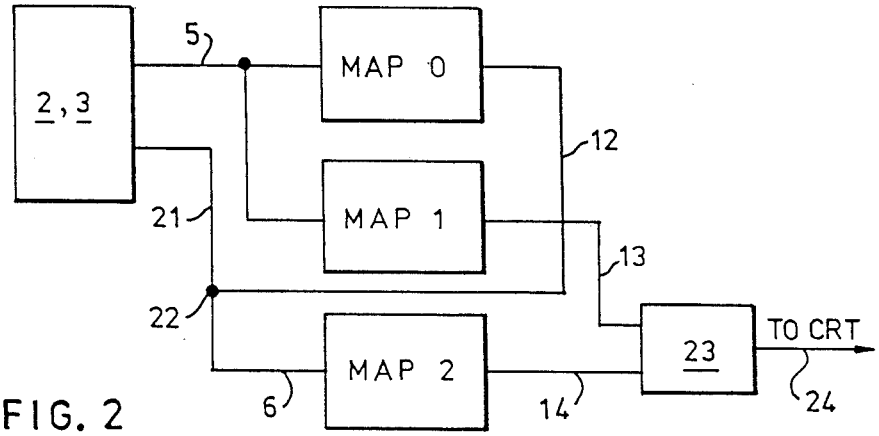
FIG. 2 is a highly simplified block diagram of the FIG. 1 display system when coupled in the character generation mode.

In the character generation mode, instead of storing bit maps representing the CRT screen image, a number of character map areas in a second of the memories each define the shape of a single character to be displayed. In addition, hexadecimal or binary representations of the characters to be selected for display in sequence are stored in a first of the memories. In operation, these each provide an address of the corresponding character map area, the content of which is read out to provide the CRT input data. In practice, a line of the binary characters is read from the first memory to provide, from the second memory, the data for the first scan line of a character, and then the binary characters are reread for the succeeding scan lines. This system is normally more economical in storage than the bit mapped system as characters will be repeated on a display, but the character map information for each character is only stored once. The character generation mode arrangement used in the present system is shown in highly simplified form in FIG. 2. Note that MAP3 is not used, and has, therefore, not been included in FIG. 2. MAP0 and MAP1 are addressed together from address unit 3 over bus 5. MAP2 is now addressed, over bus 6, by the data output of MAP0 together with a row scan output from control unit 3 over lines 21. These outputs are combined in address unit 22 to provide the MAP2 addresses. What happens is that when MAP0 and MAP1 are accessed, an 8-bit byte from MAP1 is applied to a latch/multiplexer in color generator 23. The MAP0 data (representing a single character) is combined with the row scan data to address MAP2. The MAP2 output data is serialized and used to switch the latch/multiplexer to provide either the upper or the lower four bits of the byte from MAP1 to address the color palette register once for each bit of the MAP2 byte. This process, of course continues for each character in a line of characters and each C.R.T. row scan in this line. Thus, MAP2 defines the character shape and MAP1 defines the two possible colors for each character and its background.

Figure 3:
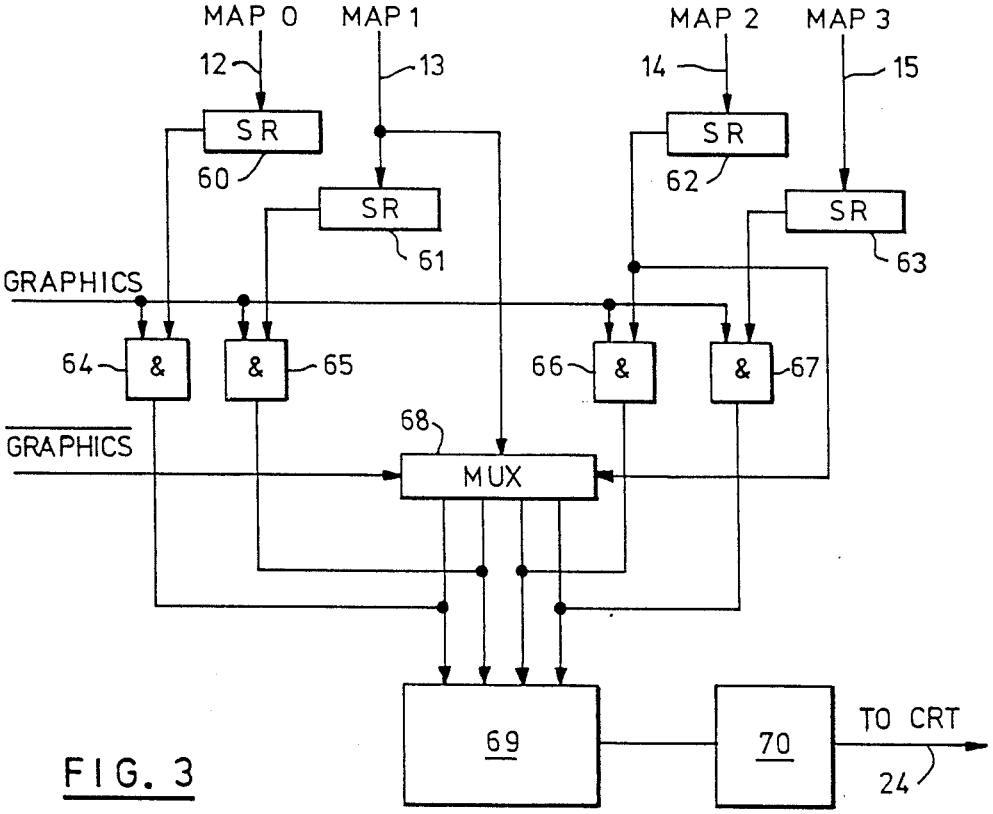
FIG. 3 is a detailed block diagram of the color generator in FIG. 1.

FIG. 3 is a detailed block diagram of color generator 23 (FIG. 1) showing the controls for its operation in both the bit mapped and character generation modes. It includes four shift registers coupled to receive data bytes from memories MAP0 through MAP3 over the busses 12 through 15. In the bit mapped mode, the GRAPHICS line is raised, thereby enabling AND gates 64 through 67. Accordingly, when the shift registers are stepped by dot clock pulses, whose timing corresponds with the dot timing of the display scan, the four bytes received simultaneously from the memories are serialized to form four bit streams. These bit streams together provide the four bit addresses for the color palette register system 69. In response to these addresses, the six bit outputs from the registers are applied to a color signal generator circuit 70 which provides the successive pel data for the CRT on output line 24. Note that in the bit mapped mode, a latch/multiplexer 68 remains disabled due to the absence of a $\overline{\text{GRAPHICS}}$ signal. In the character generation mode, all of the AND gates 64 through 67 are disabled, as no GRAPHICS signal is applied. Accordingly, none of the shift register outputs is applied to the color palette system. Latch/multiplexer 68 is now enabled by a $\overline{\text{GRAPHICS}}$ signal. The first thing that then happens is that the data from MAP1 is entered in parallel into latch/multiplexer 68. At this time, of course, MAP2 is being addressed by the data output of MAP0. The MAP2 data is serialized in shift register 62 and then applied as serial control bits to multiplexer 68 at the CRT dot clock rate. These signals switch the multiplexer to deliver either the upper or the lower four bits of the byte therein to address color palette register system 69. In other words, each '1' bit from the shift register generates one of two addresses, and each '0' bit the other of these addresses.

Figure 4:
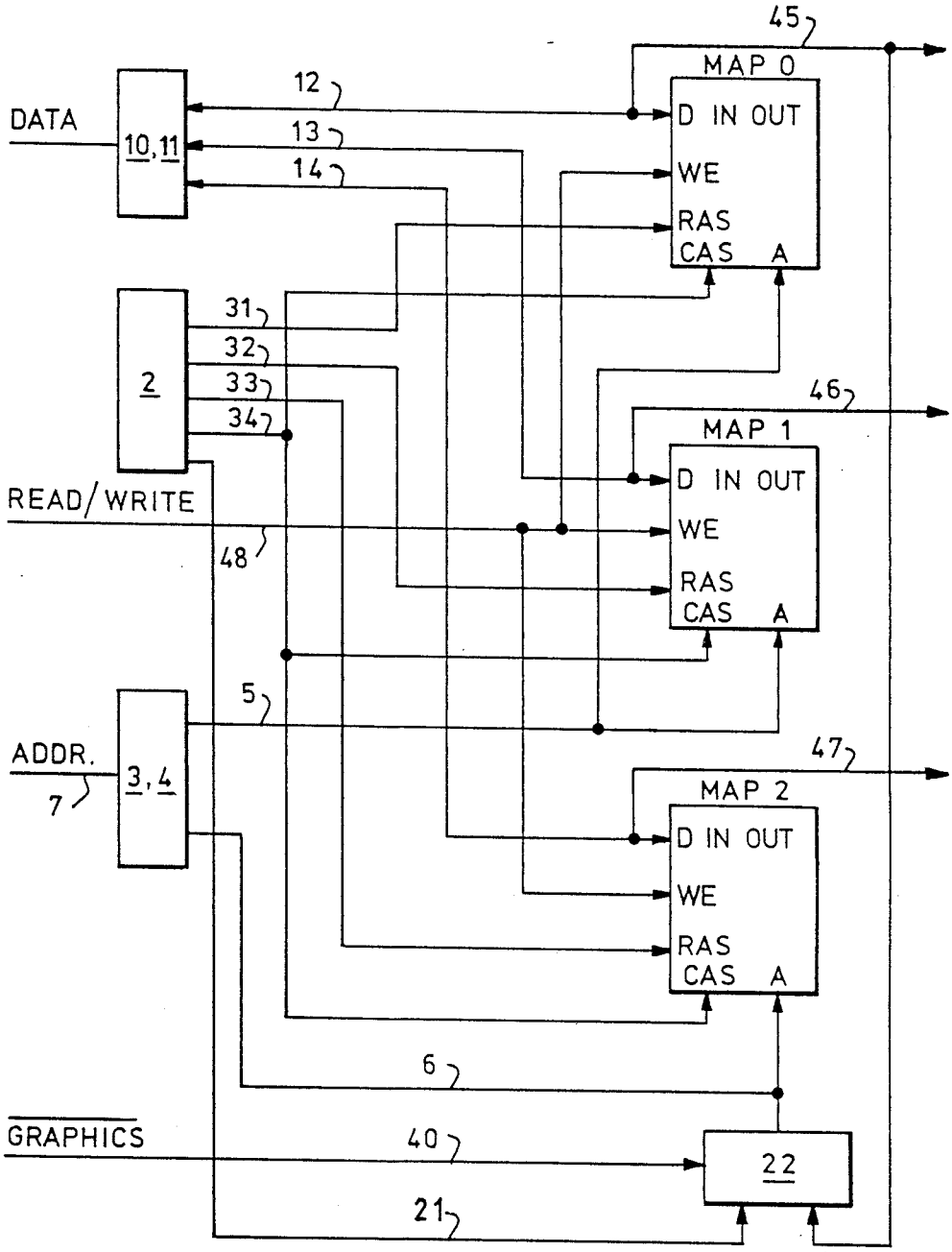
FIG. 4 is a detailed block diagram of the addressing system employed in the FIG. 1 display system.

FIG. 4 is a more detailed diagram of the addressing arrangement for the storage maps. For convenience, only MAP0 through MAP2 are shown. As shown in this figure, each map is a dynamic random access memory. As is normal for such memories, each has a data in/data out input (D IN/OUT) comprising an 8 bit connector, a write enble (WE) input, a row address strobe (RAS) input, a column address strobe (CAS) input, and an 8 bit address input (A). Each map is accessed by a 16 bit address supplied to input A as two consecutive 8 bit bytes. The first is applied in correspondance with a RAS input and is latched in the memory and the second is applied with a CAS input to complete the address. The RAS and CAS signals are developed by a timing and control system 2 and directed to the memories over lines 31 through 34. The addresses for MAP 0 and MAP 1 are generated by an address unit 3, 4 in response to CPU or CRT controller input address signals on bus 7 and sent to these maps over bus 5. In the bit mapped mode, the addresses for MAP 2 are fed from address unit 3, 4 along a bus 6. In the character generation mode, the row scan signals are passed from control unit 2 along bus 21 to the latch/multiplexer 22, where they are combined with the data output from MAP 0 prior to addressing MAP 2. As mentioned above, latch/multiplexer 22 is used when the system operates in the character generation mode, and is enabled by a $\overline{\text{GRAPHICS}}$ input (low) from the CPU on line 40. When the bit-mapped raster display mode is in operation, the addresses on lines 5 and 6 are identical.

Data is written to or read from the memories on busses 12 through 14. These busses are coupled through logic circuits 10, 11 for data transfer between the CPU and the memories. These busses are also coupled to respective busses 45 through 47, which are coupled to the serializers 60 through 62 of FIG. 3 to generate the CRT drive signals through the color palette register. Bus 45 also provides the MAP 0 input to latch/multiplexer 22. The memory reading and writing functions are determined by signals applied to the WE inputs from a read/write input line 48.

Figure 5:
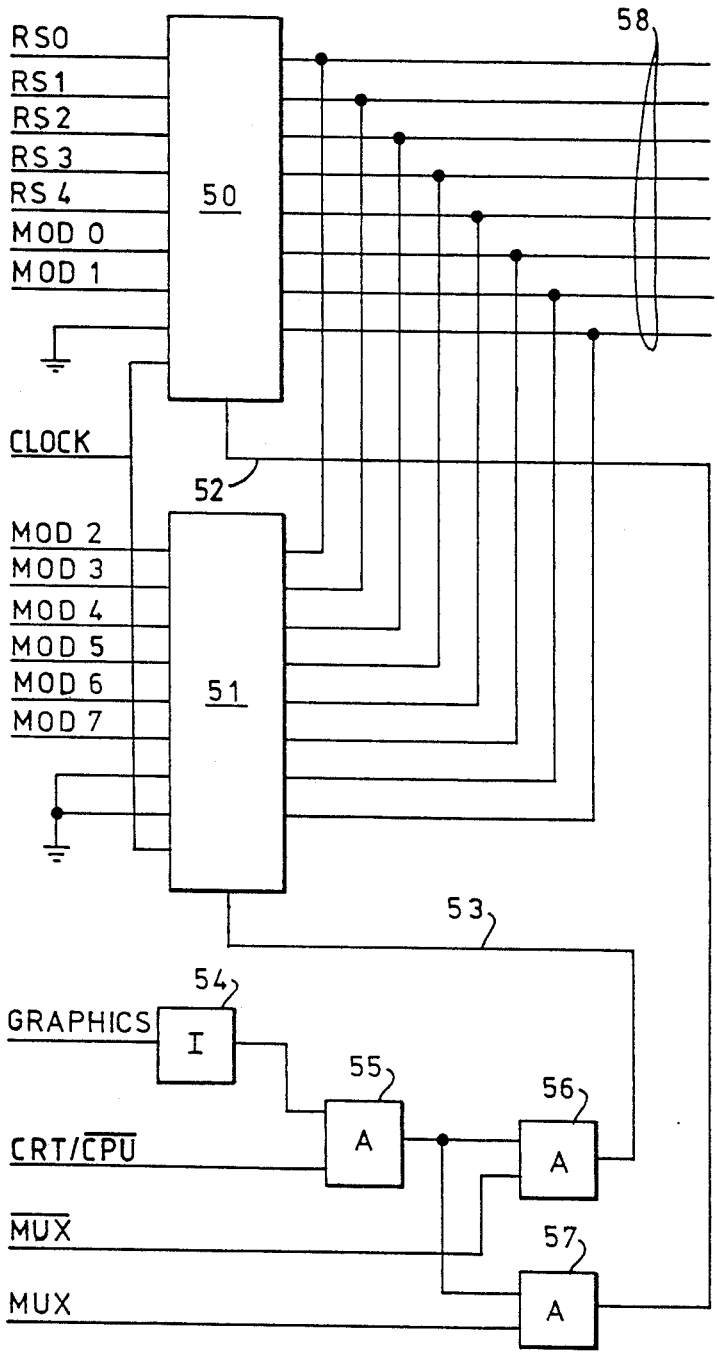
FIG. 5 is a block diagram of a latch/multiplexer system for coupling data from MAP 0 in FIG. 1 to address MAP 2 in FIG. 1.

FIG. 5 shows details of the latch/multiplexer system 22 shown in FIGS. 1 and 4. This system comprises two latches 50 and 51, each of which has eight data inputs, an enable input, a clock input and eight data outputs. Latch 50 receives, as its inputs, five row scan inputs RS0 through RS4 and two address inputs from MAP 0, MOD0 and MOD 1. Latch 51 receives the remaining address inputs, MOD2 through MOD7, from MAP 0. In latch 50 the remaining data input is grounded and in latch 51 the remaining two data inputs are grounded as shown. Thus, as has been indicated above, particularly with reference to FIG. 2, this circuit is responsive to thirteen-bit inputs which are clocked into the latches by CLOCK inputs. The respective latches 50 and 51 are responsive to enabling inputs on lines 52 and 53 to read out data therein. These lines are activated by a logic circuit comprising an inverter 54 and three AND circuits 55, 56 and 57. These logic circuits are responsive to a GRAPHICS input, a CRT/$\overline{\text{CPU}}$ input, a MUX and $\overline{\text{MUX}}$ input, all of which are developed by control circuit 2 (FIG. 1). The GRAPHICS line is raised when the system is operating in the bit mapped raster scan mode and lowered when the system is in the character generator mode. The CRT/$\overline{\text{CPU}}$ line is high when the maps are passing data to the CRT and low when they are communicating with the CPU. The MUX and $\overline{\text{MUX}}$ alternate between high and low to time the sequence of enabling latches 50 and 51 to provide the sequential eight-bit output addresses, on output lines 58, to MAP 2. Thus, when the display system is in the character generator mode (GRAPHICS input low), and is supplying signals to the CRT (CRT/$\overline{\text{CPU}}$) line, AND gate 55 supplies a high output. Then, in response to a MUX input, AND gate 57 applies a signal to line 52 to enable latch 50 to apply the first eight-bit byte to MAP 2. The second portion of the sixteen bit address for this map then follows when input $\overline{\text{MUX}}$ goes high.

In operation, for a line of characters to be displayed on the CRT, the address of the first character position is applied to MAP 0 which responds with MOD0 through MOD7 outputs which are then offset into MAP 2 for the character to be displayed. For the first scan line, all of the row scan inputs RS0 through RS4 are low. Latches 50 and 51 are read out in turn by signals on lines 52 and 53 to address, and thereby record, a byte location from MAP 2 corresponding to the top scan line of the selected character. Thereafter the position addresses for the remaining characters in the row are applied in turn to MAP 0. This responds with the MOD0 through MOD7 offset into MAP 2 as inputs of latches 50 and 51 with the RS0 through RS4 inputs remaining as above. Thus, the data for the top line in the row of characters is read out during the first scan line of the CRT. This operation is then repeated for the second scan line, except that line RS0 is raised with RS1 through RS4 low. For the third scan line, line RS1 is raised, and so on until, assuming a character set with $8 \times 12$ dots per character, the final line is scanned with the RS3, RS1 and RS0 lines raised. This operation is then repeated for each succeeding row of characters to be displayed with, of course, a new set of position addresses to MAP 0 which responds with new offset addresses on lines MOD0 through MOD7 for each new character row.

The RS0 through RS4 inputs can, of course be provided from a binary counter arranged to be incremented at the CRT line flyback time to a predetermined number, and then reset to zero. Though in the above operation, a count of eleven (plus zero) was described, it is clear that with five RS lines into latch 50, up to 32 line scans per character row may be employed. Additionally, the row dots in a character scan line may comprise more than the eight. For example, by using two output bytes from MAP 2 for each character and making full use of the RS0 through RS4 lines, 16×32 dot characters can be displayed. It is also clear that, by the use of one or more of the inputs to latches 50 and 51 which are grounded in FIG. 4, to receive RS inputs, these inputs could be increased to eight to display characters covering up to 256 scan lines each. Alternatively, more characters could be provided by the use of all the MOD lines from MAP 0, for instance if this map were 16 bits wide.

In summary what has been described is a system for producing a display on a raster scanning display device. The system employs plural stores which, in one mode, are accessed simultaneously to produce CRT drive signals from bit maps in the stores. In a second mode data from one store is employed to address a further of the stores which contains character information, and this information is employed to produce the CRT drive signals.

While the invention has been particularly shown and described with reference to a preferred embodiment, it will be understood by those skilled in the art that various other changes in form and detail may be made without departing from the spirit and scope of the invention.

We claim:

1. A raster scan display system comprising a plurality of memory devices for storing display data, means coupling the memory devices to a raster scan video signal generator to produce video signals for a raster scan display device, means for addressing the memory devices to select data for transfer to said video signal generator, and means for selectively controlling the addressing means to operate either in a bit mapped mode to address corresponding locations in each of said memory devices for simultaneous data transfer from each memory device to said video signal generator, or in a character generator mode to address locations in a first of said memory devices and to couple data read from addressed locations in the first of said memory devices to address lines of a second of said memory devices to transfer data from the second of said memory devices to said video signal generator.

2. A raster scan display device according to claim 1, in which, in the character generator mode, the first memory device has stored therein coded representations of characters to be displayed, the second memory device has stored therein display dot patterns of said characters, and the addressing means includes means responsive to the selectively controlling means for combining the data output of the first memory device with raster line count data to develop addresses for said second memory device.

3. A raster scan display system according to claim 2 including a third memory device, said addressing means being operable in said character generator mode to address corresponding locations in said first and third memory devices simultaneously, said third memory device having stored therein display data, and means for combining display dot pattern data from the second memory with display data from the third memory for transfer to said generator.

4. A raster scan display system as claimed in claim 1 in which said video signal generator includes a color palette register system comprising a plurality of registers individually selectable by said data from the memory devices to produce color defining signals from which the video signals are derived, said registers being selectable by data from all the memory devices when said addressing system is in said bit mapped mode, or by data from said second and a third of said memory devices when said addressing system is in said character generator mode, said addressing means including means for addressing corresponding locations in said first and third memory devices simultaneously in both said bit mapped and character generator modes.

5. A raster scan display system according to claim 4 in which data is read from the memory devices in parallel fashion and including a plurality of serializers each coupled to an associated one of the memory devices to serialize data therefrom, whereby in said bit mapped mode, groups of bits from the serializers each comprising a corresponding bit from each serializer, select said registers.

6. A raster scan display system according to claim 5 including a latch/multiplexer system coupled to receive and latch 2n bit parallel data words from the third memory device, where n is an integer, to receive serial control data from the serializer coupled to the second memory device, and to receive control signals from the selectively controlling means for enabling the latch/multiplexer system in said character generator mode operation, said latch/multiplexer system, when enabled, being responsive to each successive control data bit to select, in accordance with the value of the control data bit, an exclusive first or second group of n bits of a latched data word to select said registers.

7. A raster scan display system according to claim 3, in which said means for combining comprises a latch/multiplexer system coupled to receive and latch 2n bit parallel data words from the third memory device, where n is an integer, to receive said dot pattern data from the second memory as serial control data from a serializer coupled to the second memory, said latch/multiplexer being responsive to each successive control data bit to select, in accordance with the value of the control data bit, an exclusive first or second group of n bits of the latched data word to select said registers.

* * * * *